United States Patent [19]

Landsman et al.

[11] 3,963,152

[45] June 15, 1976

[54] CHILDPROOF CAP FOR AEROSOL DISPENSER

[76] Inventors: Emanuel Landsman, 245 N. Broadway, Yonkers, N.Y. 10601; Irving Landsman, 3530 Henry Hudson Parkway, Riverdale, N.Y. 10463

[22] Filed: Mar. 10, 1975

[21] Appl. No.: 557,229

Related U.S. Application Data

[63] Continuation-in-part of Ser. No. 537,913, Jan. 2, 1975.

[52] U.S. Cl. ..... 222/402.13

[51] Int. Cl.[2] ..... B65D 83/14

[58] Field of Search ..... 239/337, 373; 215/9; 251/297; 222/402.11, 402.12, 402.13

[56] References Cited

UNITED STATES PATENTS

| | | | |
|---|---|---|---|
| 2,913,749 | 11/1959 | Ayres | 222/402.12 X |
| 3,409,186 | 11/1968 | Melocchi | 222/402.13 |
| 3,608,785 | 9/1971 | Durse et al. | 222/182 |
| 3,844,448 | 10/1974 | Sette | 222/402.11 X |

*Primary Examiner*—Stanley H. Tollberg
*Assistant Examiner*—Norman L. Stack, Jr.
*Attorney, Agent, or Firm*—Arthur B. Colvin

[57] ABSTRACT

The invention relates to a safety closure cap for a device for dispensing a liquefied gas propellant including one or more active ingredients such as is used for insecticides or exterminating purposes. More particularly, the device, which is commonly known as an "Aerosol Bomb" comprises a container of conventional type having a discharge nozzle which when pressed will activate a valve to release the contents of container as a spray. The container has an annular flange at its upper end and the cap, according to the invention, has a cylindrical side wall with means at its lower edge to interengage with the annular flange to retain the cap in position yet permit relative longitudinal movement of the cap with respect to the nozzle. The cap has inwardly movable means carried by the side wall thereof, adapted releasably to grip a sleeve mounted on the nozzle so that when the cap is moved longitudinally outwardly with respect to the container; the gripping means are then moved inwardy to engage the actuating sleeve and the cap is then moved longitudinally inwardly with respect to the container with the sleeve still gripped, the valve controlled by the nozzle will be actuated for discharge of the contents of the container.

5 Claims, 10 Drawing Figures

FIG. 1
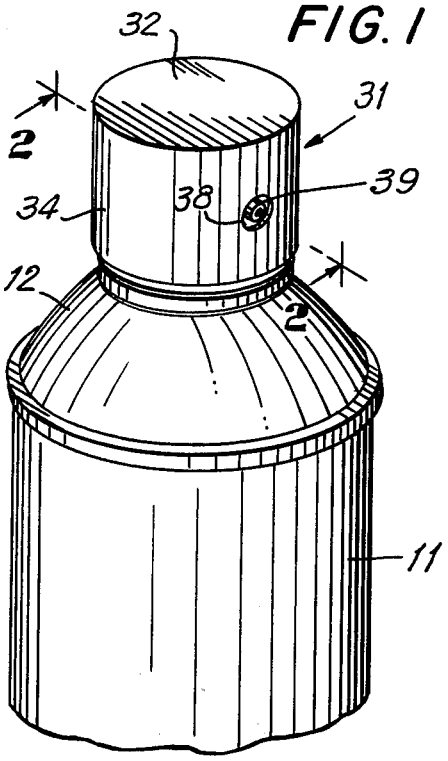
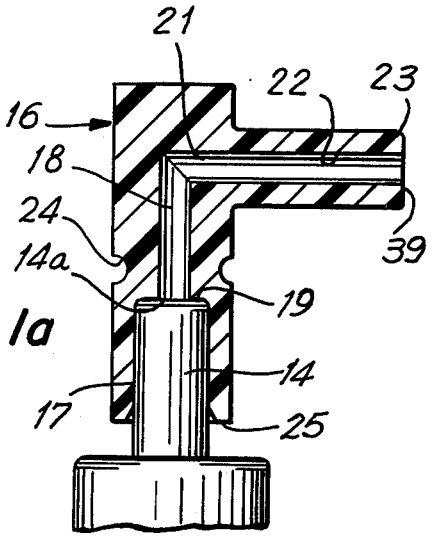
FIG. 1a
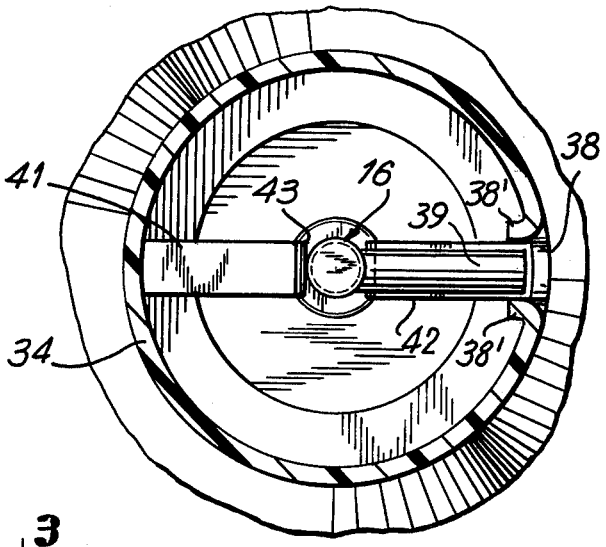
FIG. 3
FIG. 2
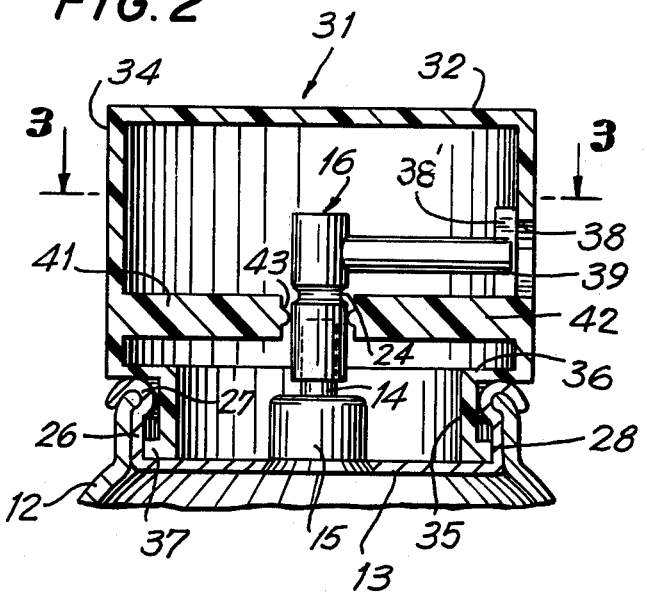

CHILDPROOF CAP FOR AEROSOL DISPENSER

This application is a continuation-in-part of copending application Ser. No. 537,913 filed Jan. 2, 1975.

As conducive to an understanding of the invention it is noted that with the ever increasing use of aerosol cans in the home to dispense a wide variety of products, situations have arisen in which young children, who are unaware of the potential danger of the product, particularly when the active agent is an insecticide, pick up the can and actuate the latter with resultant harmful consequences.

Numerous types of safety closure caps have been devised to prevent inadvertent actuation by a child. However, in many cases such caps are either so complex that it is even difficult for an adult to use without detailed instructions, or so simple that they also can be operated by a child.

Furthermore, where the safety caps include numerous movable elements and locking mechanisms, the cost of manufacture renders them commercially unfeasible and they are likely to become damaged if the container is dropped.

It is accordingly among the objects of the invention to provide a safety closure cap for a pressurized dispenser or aerosol bomb of the type comprising a conventional container having a discharge nozzle, which cap may readily be fabricated at low cost with a simple molding operation and which is devoid of pivots, links, plungers or other movable elements that are not an integral part of the cap, and which cap itself defines the actuating means for depressing the nozzle of the dispenser with a few simple movements which may readily be accomplished by an adult but which are beyond the capabilities of a young child.

According to the invention these objects are accomplished by the arrangement and combination of elements hereafter described and more particularly recited in the claims.

In the accompanying drawings in which are shown one or more of various possible embodiments of the several features of the invention:

FIG. 1 is a perspective view of the aerosol container and safety cap, according to one embodiment of the invention;

FIG. 1*a* is a detail sectional view on an enlarged scale of the nozzle cap;

FIG. 2 is a longitudinal fragmentary sectional view of the safety cap mounted on the aerosol can in normal position;

FIG. 3 is a sectional view taken along line 3—3 of FIG. 2;

Figure 4:
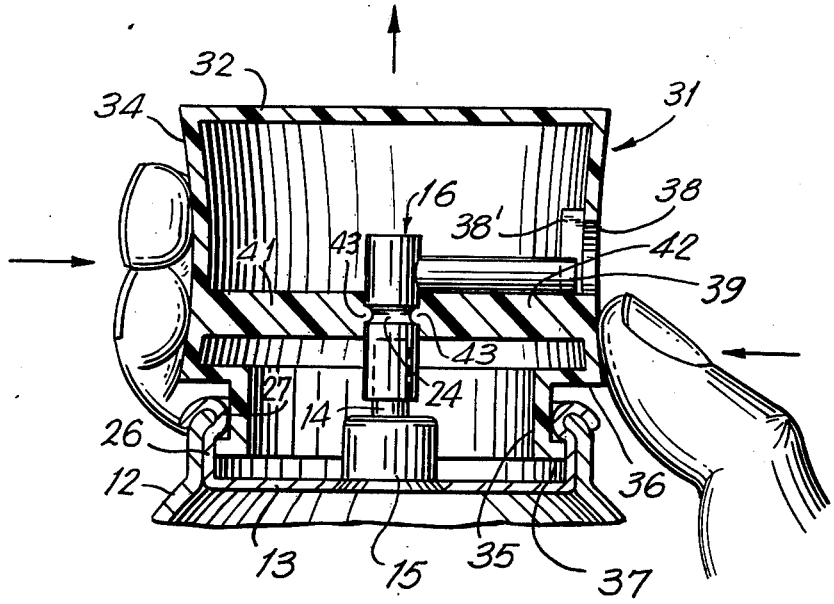
FIG. 4 is a view similar to FIG. 2, showing the cap in a second position of operation.

Referring now to the drawings, as shown in FIG. 1, the liquified gas propellant, as well as the active ingredients comprising the insecticide, are enclosed under pressure in a container 11. The container has an upwardly domed end 12 surrounding the end wall 13 of the container, from which protudes an axial discharge nozzle 14, which coacts with a valve 15, which is opened when the nozzle 14 is depressed to permit ejection of the contents of the container through the nozzle 14 in the form of a spray.

Mounted on nozzle 14 is an actuating sleeve or cap 16, one end of which has an axial bore 17 receiving the nozzle 14, preferably by force fit. The bore 17 is in communication with a reduced diameter axial bore 18 defining an annular actuating shoulder 19 and the bore 18 is in communication with a transverse bore 21 which in turn is in communication with the bore 22 of an outlet nozzle 23 extending radially outward from cap 16 and preferably formed integral therewith. The cap 16 is formed with an annular groove 24 in its periphery between the outlet nozzle 23 and the end 25 of the cap into which discharge nozzle 14 extends.

The domed end 12 of the container has an annular rim 26 rising therefrom, the latter having an inwardly extending annular flange 27 defining an annular recess 28 with respect to the end wall 13 of the container.

According to the invention in the embodiment shown in FIGS. 1 to 5 a cup-shaped cap 31 is provided which preferably is formed by molding from a suitable plastic such as polyethylene. The cap is sufficiently rigid so as to maintain its shape and properly protect the nozzle yet may be deformed in order to actuate the nozzle in the manner hereinafter to be described.

More particularly, as shown in FIGS. 1 and 2, the cap has a top wall 32 and a depending cylindrical side wall 34 of reduced diameter at its lower end as at 35 defining an annular shoulder 36, an annular flange 37 extending outwardly from the lower end of reduced diameter wall portion 35.

The flange is of diameter such that it may be force fitted over annular flange 27 so that flange 37 will be positioned in annular recess 28 and movable longitudinally therein.

As a result of the "elastic memory" of the plastic forming the cap 31, after the lower portion 35 is deformed inwardly to permit the annular flange 37 to snap over the annular flange 27, it will then return to its original shape. As a result, the cap 31 will be dependably secured to the annular rim 26 yet able to be moved axially with respect thereto, an opening 38 in side wall 34 of cap 31 being aligned with the end 39 of outlet nozzle 23 in all operating positions of cap 31 by means of parallel guide 38' molded in the interior of the cap and straddling the outer end of the nozzle when cap 31 is positioned on rim 26.

Extending radially inwardly from opposed sides of the cap 31 and diametrically aligned therewith are ribs 41, 42. The outer end of each of the ribs 41,42 is preferably formed integrally with the side wall 34 and the inner end of each of the ribs is formed with a gripping member in the form of an outwardly extending boss or protruberance 43. Due to the thickness in cross section of each of the ribs 41, 42, they are relatively rigid as compared to the rigidity of the side and top walls 34, 32 of the cap 31 for the purpose herein after described.

With the cap 31 mounted on the upstanding rim 26, and with the shoulder 36 seated on the annular flange 27 at the upper edge of rim 26, due to the length of the lower portion 35 of side wall 34 the inturned flange will be located adjacent the end wall 13 of the container.

With the cap 31 initially positioned as above described, the nozzle cap 16 will be straddled by the opposed bosses 43 at the ends of ribs 41, 42, the latter at such time lying in a transverse plane below that of annular groove 24 in nozzle cap 16.

In order to actuate the valve 15, the user must grasp the container 11 in one hand and then lift up on the cap 31 with the other hand, such upward movement of the cap being limited by the abutment of flange 37 against flange 27. As a result of such upward movement of the cap, it will be positioned as shown in FIG. 4 and the bosses 43 at the ends of ribs 41, 42 will also be displaced upwardly with respect to the nozzle cap 16, and substantially aligned with the plane of annular groove 24 in cap 16.

Thereupon the user, still gripping the container 11 in one hand, presses inwardly on opposed sides of the side wall 34 of the cap at the regions thereof shown by the arrows in FIG. 4 of the cap diametrically aligned with the ribs 41, 42, such positions being indicated by appropriate markings on the exterior of said wall 34. As a result of such inward forces, due to the rigidity of the ribs 41, 42 and the flexibility of the side wall 34 of the cap 31, the side wall 34 will deform inwardly at the regions of pressure as shown in FIG. 4, forcing the ribs 31, 32 inwardly so that the opposed bosses 43 will enter into annular groove 24 and will tightly grip the nozzle cap 10 therebetween.

Figure 5:
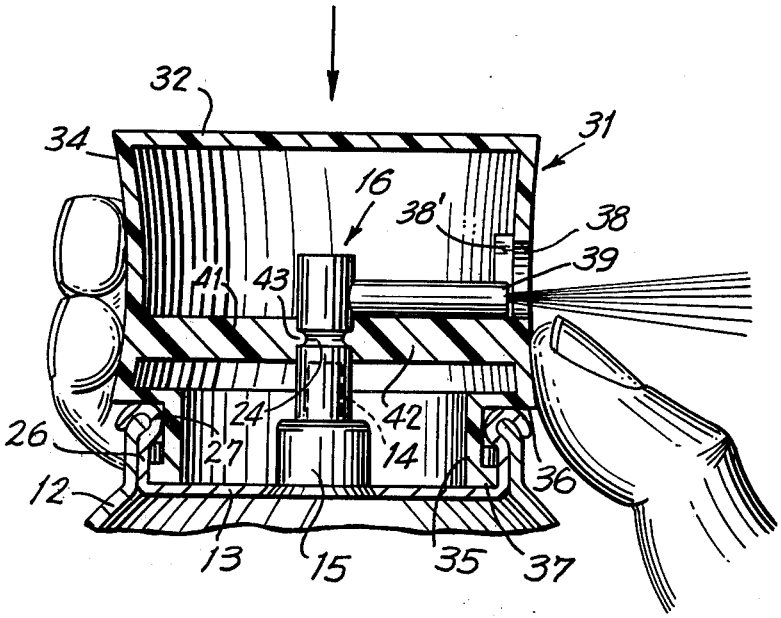
FIG. 5 is a view similar to FIG. 2, showing the cap in position actuating the valve.

Thereupon, still pressing inwardly on the opposed portions of side wall 34 of the cap with one hand and holding the container in the other hand, the user then moves the cap downwardly to the position shown in FIG. 5. As a result, the nozzle cap 16 will be moved downwardly so that the shoulder 19 will abut against the upper end 14a of nozzle 14 and move said nozzle 14 downwardly. The distance of travel of the nozzle cap 16 is such that the valve 15 will be actuated by such downward movement of nozzle 14 so that the contents of the container will be discharged through bores 18, 21 and of outlet nozzle bore 22 and out of opening 38.

If the user should release the pressure applied to the opposed portions of side wall 34, due to the "elastic memory" of the plastic material from which the cap 31, is formed, the latter will assume its original shape so that the ribs 41, 42 will move outwardly, with the result that the opposed bosses 43 will move away from annular groove 24 in nozzle cap 16. Hence, due to the conventional spring controlling the valve 15, the nozzle 14 and cap 16 mounted thereon will be forced outwardly and the valve 15 will close, cutting off further discharge.

It is apparent that unless the operating procedures above described are followed in the sequence indicated, the valve 15 cannot be actuated. The procedure is of course relatively simple for an adult to follow but would be extremely difficult to be performed by a young child and the likelihood of accidental operation by such young child is minimal, if not impossible.

Thus, for example, with the cap 31 in its normal downward position shown in FIG. 2, if downward pressure is exerted against the cap 31, as the shoulder 36 abuts against flange 27, no downward movement would be imparted to the cap 31. Hence no downward movement would be imparted to the nozzle cap 16 or to the nozzle 14 which could cause actuation of valve 15.

If downward pressure should be exerted against the cap 31 and the sidewall portion 24 should be pressed inwardly simultaneously causing the bosses 43 to grip the nozzle cap 16 since as above described, the cap would not move downwardly, no actuation of valve 15 could occur.

Even if some remote chance the child should first lift the cap 31 so that it moved upwardly with respect to the container, and then the child pressed the cap 31 downwardly, no actuation of the nozzle would occur unless the child at the same time gripped the container in one hand and pressed the portion of side wall 34 at the regions thereof aligned with ribs 41, 42. The likelihood of such relatively complex procedure being inadvertently performed is of course highly improbable.

Figure 6:
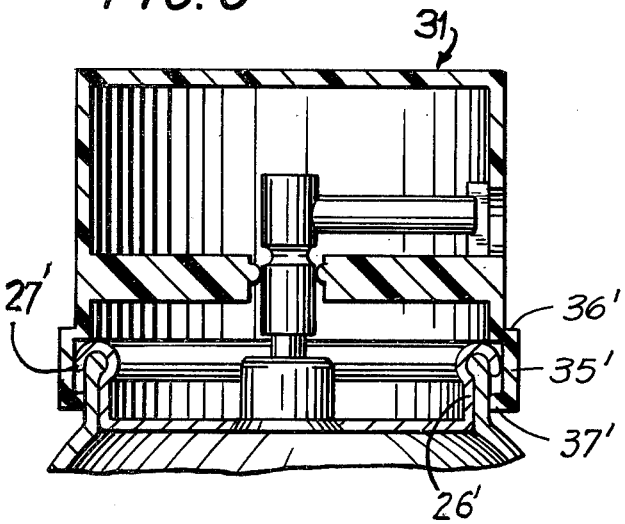
FIG. 6 is a fragmentary detail view of another embodiment of the invention.
Figure 6:
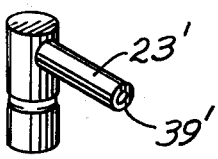

Although in the embodiment shown in FIGS. 1 to 5, for example, the cap 31 is retained on the upstanding rim 26 by having the flange 37 of the cap positioned inwardly of the rim 26, it is within the scope of the invention as shown in FIG. 6 to have the flange 37' positioned exteriorly of the upstanding rim 26' so that it will engage the outwardly extending flange 27' when the cap 31 is lifted.

In the embodiments shown in FIGs. FIGS. to 6, the cap 31 is provided with an opening 38 in its side wall 34 to permit discharge from outlet nozzle 23, the end of which is positioned interiorily of cap 31.

Figure 7:
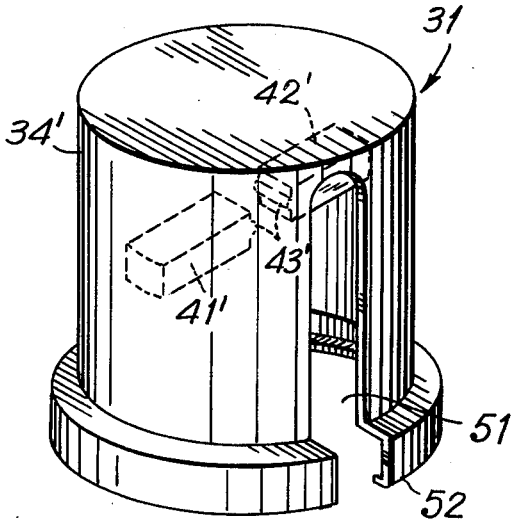
FIG. 7 is a view similar to FIG. 2 of still another embodiment of the invention.

In the embodiment shown in FIG. 7, the same safety features are present as in the embodiments of FIGS. 1 to 6, but the cap has a slot 51 in its side wall 34' extending from the lower edge 52 of the cap 31, the outlet nozzle 23' being aligned with slot 51, and the end 39' of the nozzle 23' illustratively protruding outwardly from said slot 51.

Figure 9:
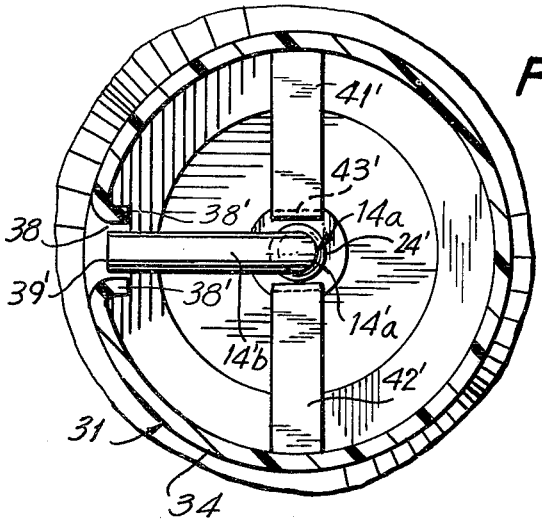
FIG. 9 is a sectional view taken along line 9—9 of FIG. 8.
Figure 8:
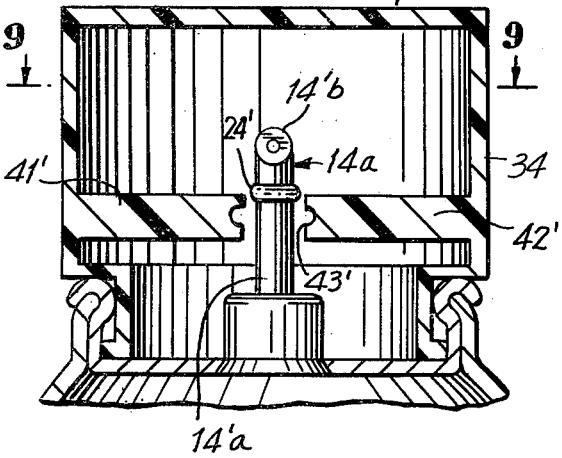
FIG. 8 is a view similar to FIG. 2 of still another embodiment of the invention.
Figure 8:
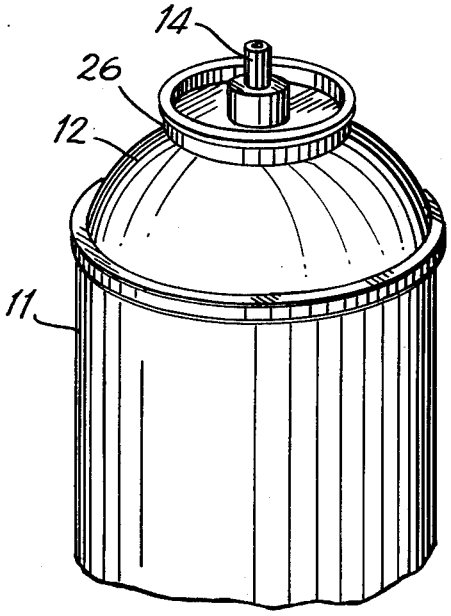

In the embodiment shown in FIGS. 8 and 9 the same safety features are also present as in the embodiments of FIGS. 1 to 7.

In the embodiment of FIGS. 8 and 9 the cap 31 has an aperture 38 in side wall 34 thereof. parallel, vertical ribs 38' are associated with aperture 38 similar to the arrangement shown in FIG. 2. The discharge nozzle **14*a* of the embodiment shown in FIGS. 8 and 9 has a portion 14'*a* extending axially from the end wall 13 and a portion 14'*b* which defines the outlet nozzle extending radially as shown in FIG. 9 with the end 39' of the portion 14'*b* being spaced slightly inwardly from the side wall 34 and positioned between the pair of vertical ribs 38'.**

In addition the ends of each of the ribs 41', 42' has a groove 43' adapted to be moved into alignment with an annular bead 24' in the axial portion **14'*a* of the discharge nozzle 24*a* in the operating position of the cap 31 so that the annular bead 24' may be gripped between the grooves 43' when the side wall 34** of the cap is squeezed inwardly.

Having thus described our invention, what we claim as new and desire to secure by Letters Patent of the United States is:

1. An aerosol bomb comprisng a pressurized container having a top end wall, said end wall having a longitudinally upstanding annular rim with an annular retaining flange at its free end and having a nozzle extending axially from said end wall and a normally closed valve actuated by inward movement of said nozzle, said nozzle having a portion extending axially from said valve and a portion extending substantially radially from the outer end of said axial portion, said radial portion defining a discharge outlet, a cap having a continuous annular side wall, means at the lower end of said side wall interengaging with said retaining flange for retention of said cap on said rim yet permitting limited relative longitudinal movement between said cap and said rim and nozzle a predetermined distance between a retracted dispensing position and an extending nondispensing position, and inwardly movable actuator means carried by said cap to grip said axial nozzle portion for axial inward movement of said nozzle and actuation of said valve only when said cap is moved from said extended position to said retracted position and said inwardly movable actuator means are actuated, said cap having means in the side wall thereof to permit discharge therethrough of the container contents through the nozzle discharge outlet when the valve is actuated.

2. The combination set forth in claim 1 in which the means in said cap side wall to permit discharge therethrough comprises an aperture in the side wall in alignment with the end of the nozzle outlet.

3. The combination set forth in claim 1 in which the means in said cap side wall to permit discharge therethrough comprises an aperture in the side wall in alignment with the end of the nozzle outlet, the outer end of the said nozzle outlet being positioned inwardly of the side wall of said cap and means to retain the end of said nozzle outlet in alignment with said aperture.

4. The combination set forth in claim 1 in which the side wall of the cap is deformable, said inwardly movable means comprises a pair of diametrically aligned ribs, each rib having one end secured to the side wall of the cap and extending radially inward therefrom, and the other end positioned adjacent to the axial portion of said nozzle, complementary clamping means being provided at the inner end of said ribs and said axial portion of said nozzle.

5. The combination set forth in claim 1 in which the side wall of the cap is deformable, said inwardly movable means comprises a pair of diametrically aligned ribs, each rib having one end secured to the side wall of the cap and extending radially inward therefrom, and the other end positioned adjacent to the axial portion of said nozzle, complementary clamping means being provided at the inner end of said ribs and said axial portion of said nozzle, the radial portion of said nozzle extending at right angles to said diametrically aligned ribs.

* * * * *